US005154012A

United States Patent [19]

Kallenberger

[11] Patent Number: 5,154,012

[45] Date of Patent: Oct. 13, 1992

[54] SUPPORT TUB FOR DRAGLINE EXCAVATING MACHINE

[75] Inventor: Harvey J. Kallenberger, Wind Lake, Wis.

[73] Assignee: Harnischfeger Corporation, Brookfield, Wis.

[21] Appl. No.: 747,175

[22] Filed: Aug. 19, 1991

[51] Int. Cl.[5] ..... E02F 3/46

[52] U.S. Cl. ..... 37/116; 37/115; 37/135; 212/253

[58] Field of Search ..... 37/115, 116, 117, 135, 37/118 R, 71; 212/253; 254/14, 30

[56] References Cited

U.S. PATENT DOCUMENTS

| | | | |
|---|---|---|---|
| 4,329,795 | 5/1982 | Kalve | 37/116 |
| 4,423,560 | 1/1984 | Rivinius et al. | 37/116 |
| 4,769,932 | 9/1988 | Kalve | 37/115 |
| 5,040,314 | 8/1991 | Kalve | 37/116 |

*Primary Examiner*—Dennis L. Taylor
*Assistant Examiner*—J. Russell McBee
*Attorney, Agent, or Firm*—Richard C. Ruppin

[57] ABSTRACT

A support tub for a dragline excavating machine having an outer peripheral wall and top and bottom walls respectively affixed to an upper edge and a lower edge of the outer wall. The bottom wall rests on the ground during excavating operation of the machine and a circular ring support on which a circular rail is mounted is positioned above the top wall. The machine is rotatably movable on the rail and is thereby supported through the ring support by the tub. The tub includes an inner ring wall concentric with the track circular ring support, a plurality of vertically disposed radial plates each extending radially outward from the inner ring wall to the outer peripheral wall, and a plurality of vertically disposed chordal plates each extending in the direction of a chord of the outer peripheral wall. A plurality of triangular compartments are each formed by the intersection of two of the chordal plates and a radial plate or by the intersection of three chordal plates. A plurality of intersections are formed by the intersecting of different groups of three of the plurality of chordal plates and a plurality of intersections are formed by the intersecting of different groups of two of the plurality of chordal plates and one of the plurality of radial plates. Pairs of radial plates are aligned and, together with the ring wall, form a continuous diameter member across the peripheral outer wall. All of the triangular compartments are equilateral sided and are of the same size.

15 Claims, 3 Drawing Sheets

56
44
52
50
52
36
42
58
54
48
46
52
8
60
40
14
22
38
4
11
10
6

28
30
34
2
32

SUPPORT TUB FOR DRAGLINE EXCAVATING MACHINE

FIELD OF THE INVENTION

This invention relates to dragline excavating machines which have as their main support during excavating operations, support tubs which rest on the ground. In particular, the invention relates to such tubs which utilize a support plate construction within the tub for support of the excavating machine.

BACKGROUND OF THE INVENTION

Large dragline excavating machines are typically supported on stationary tubs during excavating operations of the excavating machines. The stresses created by the weight of the excavating machines and their excavating movements place large forces on the tubs requiring the tubs to be correspondingly large in size and strength. Larger excavating machines also are movable from one location to another by walking mechanisms which lift the machine up and move it forward in a walking type movement. During each walking step, the tub is picked up by the frame of the machine and moved with the machine. Such lifting movement also requires that the tub be of high strength to withstand the forces due to its own weight when lifted.

Various prior art tub constructions have been used in dragline excavating machines, all with the purpose of obtaining a high level of tub strength and rigidity. In these constructions, a tub utilizes support plates arranged to provide a rectangular grid of plates forming rectangular support compartments or trapezoidal-like compartments formed by radial and circumferentially directed plates. The instant invention is an improvement to tub constructions in which the support plate arrangement provides a number of benefits over presently known constructions.

SUMMARY OF THE INVENTION

It is a general object of the invention to provide a support tub for a dragline excavating machine in which the supporting compartments of the tub are of particularly high strength and provide broad distribution of the load on the tub, and minimize both the design and manufacturing work required to produce the tub.

The invention is carried out by providing a support tub for a dragline excavating machine in which the tub has an outer peripheral wall, and top and bottom walls respectively affixed to an upper edge and a lower edge of the outer wall. The bottom wall rests on the ground during excavating operation of the machine and a circular ring support on which a circular rail is mounted is positioned above the top wall. The machine is rotatably movable on the rail and is thereby supported through the ring support by the tub. The tub further includes an inner ring wall concentric with the track circular ring support, a plurality of vertically disposed radial plates each extending radially outward from the inner ring wall, and a plurality of vertically disposed chordal plates each extending in the direction of a chord of the outer peripheral wall. A plurality of triangular compartments are each formed by the intersection of two of the chordal plates and a radial plate or by the intersection of three chordal plates.

A plurality of intersections are formed by the intersecting of different groups of three of the plurality of chordal plates and a plurality of intersections are formed by the intersecting of different groups of two of the plurality of chordal plates and one of the plurality of radial plates. With such supporting intersections, the force of the weight of the excavating machine on the tub is distributed in six directions along support plates at each one of the intersections of the chordal and chordal or radial plates.

The plurality of radial plates preferably each extend radially outward from the ring wall to the outer peripheral wall. Pairs of radial plates are radially aligned and, together with the ring wall, form a continuous diameter member across the peripheral outer wall. Preferably also, all of the triangular compartments of which the tub is comprised are of the same size. The triangular compartments are equilateral sided compartments so that the angular width between each compartment side is 60°. At each intersection of the plates which forms the angular width between plate sides, the plates are welded together. The resulting 60° weld width is relatively small compared to the weld width required for compartments with 90° side intersections so that the total weld cost is minimized.

BRIEF DESCRIPTION OF THE DRAWINGS

Further objects and advantages of the invention will appear when taken in conjunction with the accompanying drawings, in which.

DESCRIPTION OF THE PREFERRED EMBODIMENT OF THE INVENTION

Figure 1:
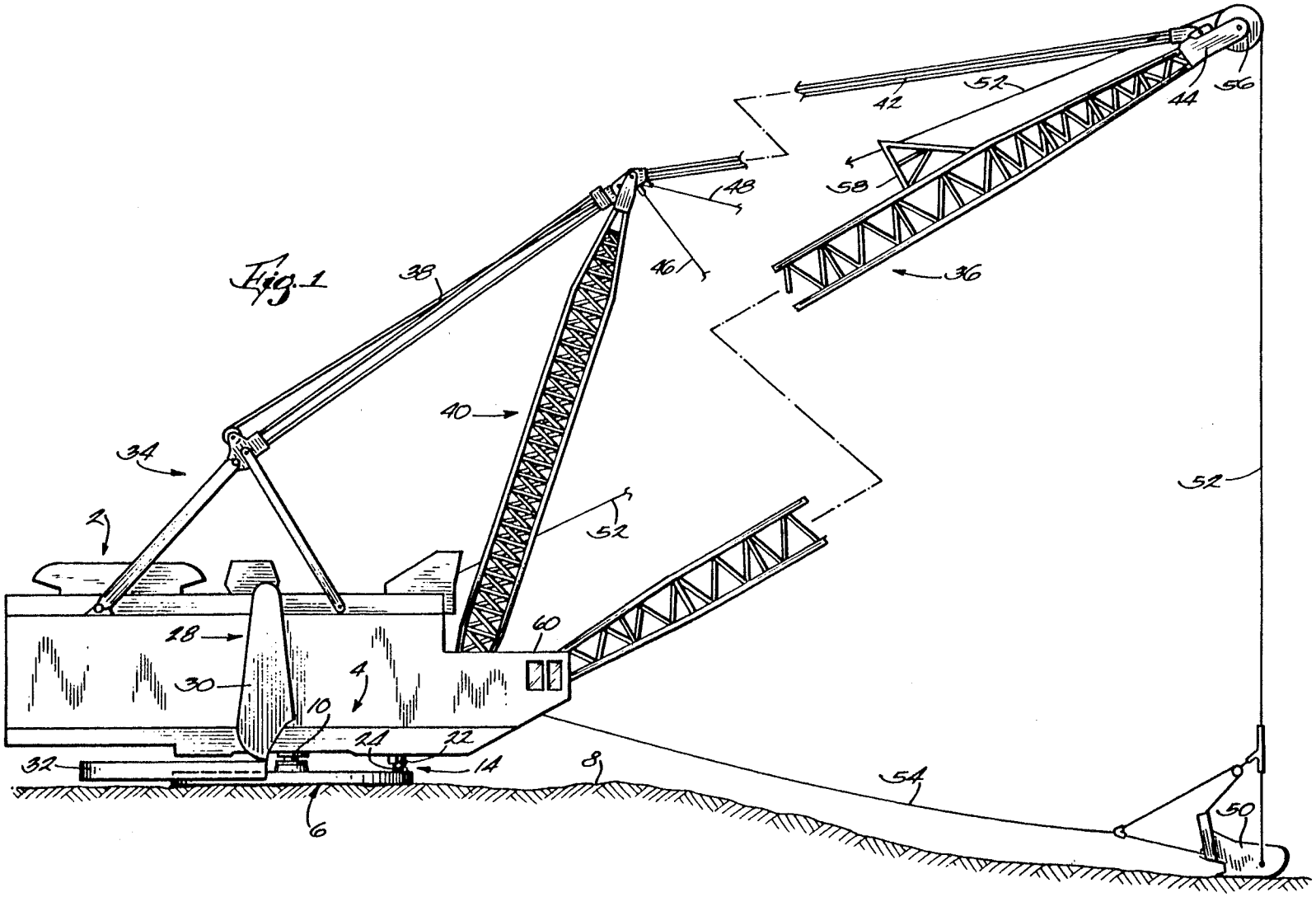
FIG. 1 is a side elevation view, partially broken away, of a dragline excavating machine incorporating the support tub of the invention.
Figure 2:
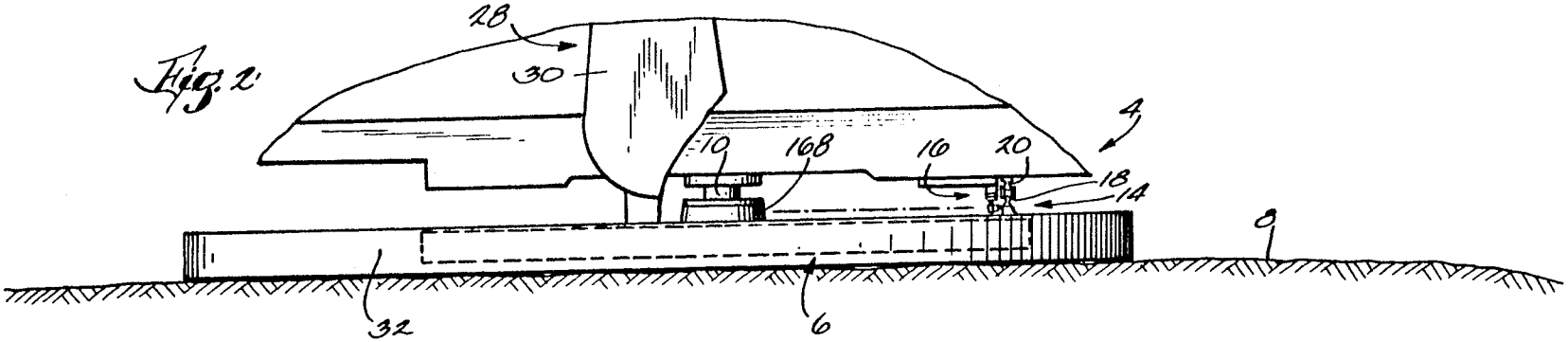
FIG. 2 is a side elevation view of a portion of the dragline excavating machine shown in FIG. 1 during operation of the walking mechanism of the machine.
Figure 4:
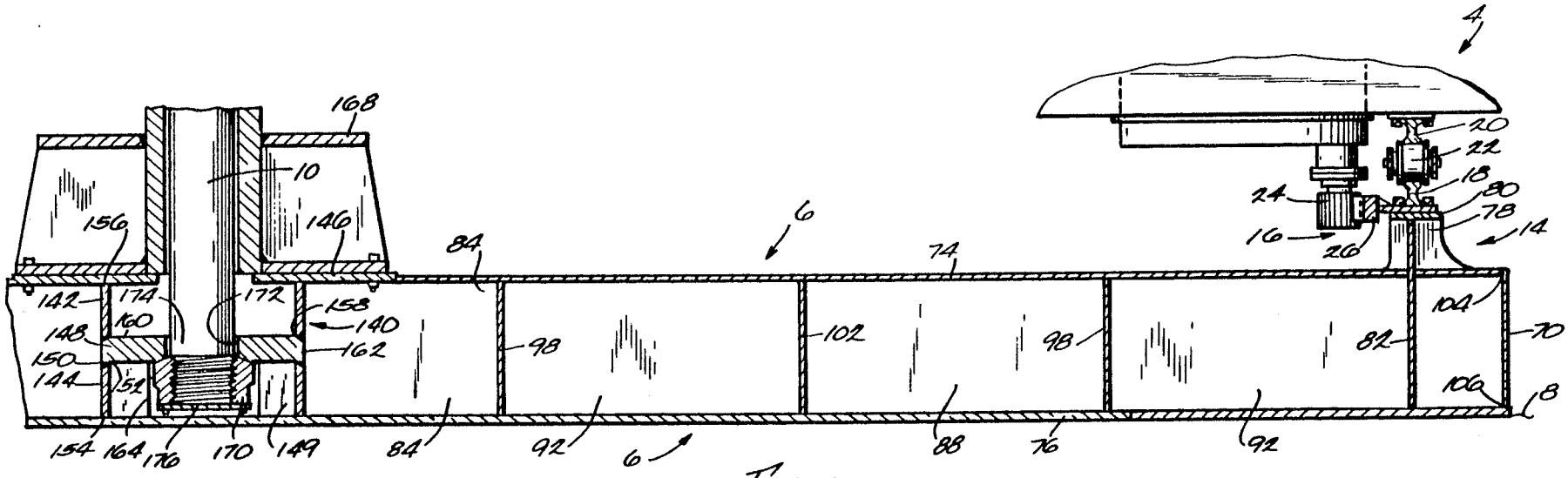
FIG. 4 is a cross-sectional view, taken along lines 4—4 of FIG. 3, and including additional components of the dragline excavating machine not shown in FIG. 3.

Referring generally to FIG. 1, the dragline excavating machine is shown as having a frame 2 mounted on a deck 4 which are together rotatably supported on a support comprising a tub 6. A fixed mast 34, pivotal mast 40 and boom 36 are mounted on the frame 2. A walk mechanism 28 is connected to the frame and deck. The tub 6 is the main support for the excavating machine and rests on the surface of the ground 8. The excavating machine is rotatable relative to the tub 6 about a lifting pin 10 connected to the deck 4 and to a lifting stool 140 of the tub 6, as shown in FIG. 4. The tub 6 also includes a rail support 14 which, together with a swing drive mechanism and support 16 permits support of the frame 2 and deck 4 in a rotatable manner by the tub 6. The drive mechanism and support 16 includes a circular rail 18 mounted on the rail support 14, a facing circular rail 20 mounted on the deck 4, a plurality of freely rotatable support rollers 22, only one of which is shown in FIG. 1, positioned between the rails. The deck and frame are rotatably driven in a swinging manner relative to the tub 6 by a gear drive 24 engaging a circular ring gear 26 supported by the rail support 14. The walk mechanism 28 is of a type well known in the art and includes an eccentric drive 30 and a pair of ground engaging feet 32, only one of which is shown, for supporting the excavating machine when the frame, deck and tub are picked up and moved by the eccentric drive as will be described in greater detail hereinafter.

Upstanding from the frame 2 is the fixed mast 34 providing an anchorage from the frame 2 to hold the boom 36. Anchor cables 38 are connected between the fixed mast 34 and the pivotally movable mast 40 and anchor cables 42 are connected between the upper end of the movable mast 40 and an outward end 42 of the boom 36. Support cables 46 and 48 also extend from the upper end of the movable mast 40 to locations on the boom intermediate its length. An excavating bucket 50 is raised and lowered by a lift line 52 and pulled toward the excavating machine when the bucket is on the ground by a pull line 54. The lift line 52 passes over a sheave 56 on the outward end 44 of the boom, through a line guide 58 mounted on the boom, and then into the housing area within the frame 2. The pull line 54 also leads into the housing area of the frame 2 and both lines wrap around drum winding machinery within the housing formed by frame 2.

An operator's cab 60 is provided at the forward end of the frame 2 and has located within it the necessary controls for paying out and taking in lift lines 52 and pull line 54 to perform a digging, lifting and dumping operation of the bucket 50. Controls are also located in the operator's cab for swinging the frame, deck, mast, boom and shovel on the tub 6 and for operating the walk mechanism 28 to move the excavating machine from one location to another.

Figure 3:
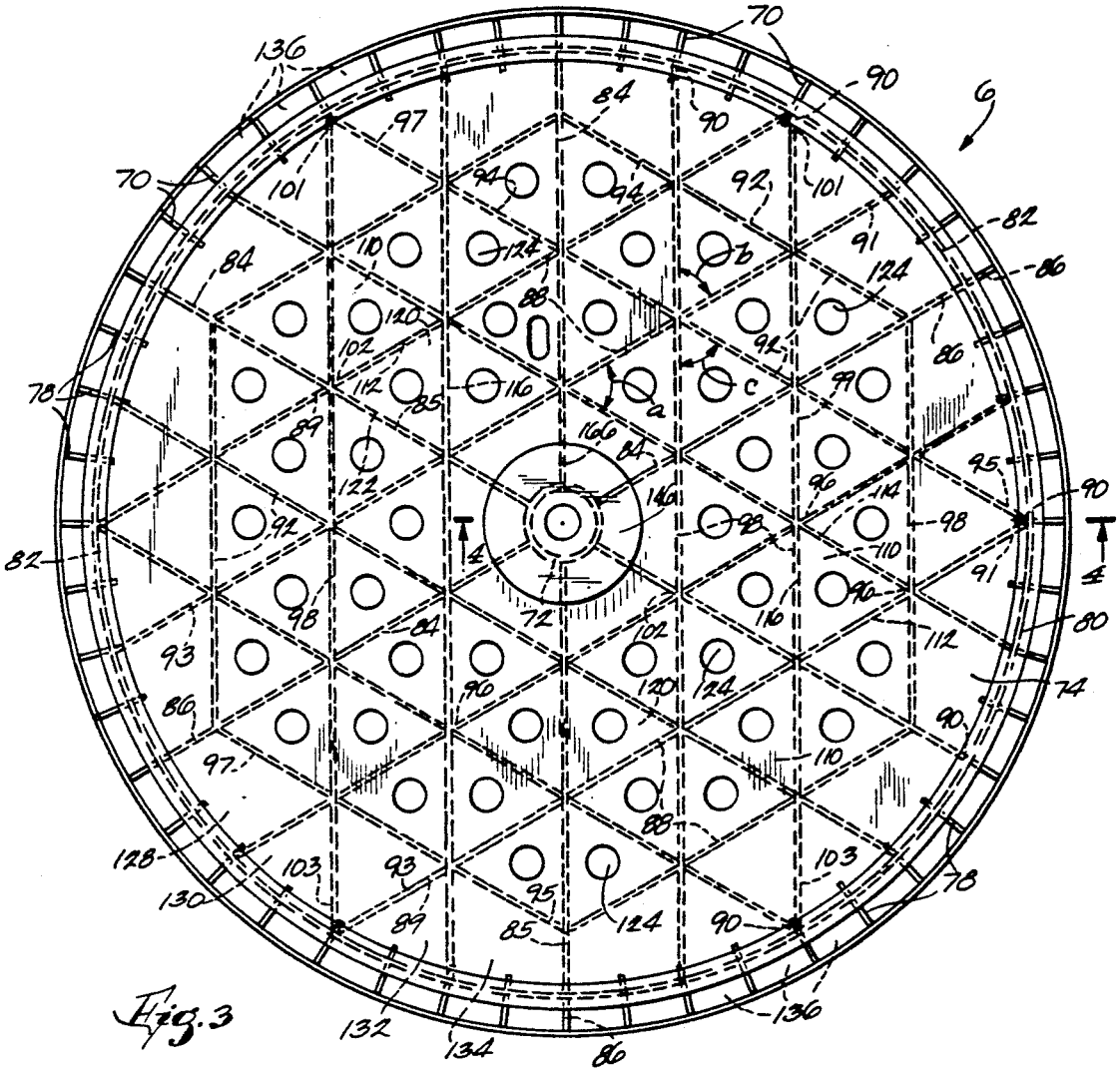
FIG. 3 is a plan view of the support tub according to the invention.

As previously described, the tub 6 rests on the ground during normal operation of the digging machine and supports the entire very substantial weight of and is subject to the high level of stresses caused by the machine. It is obviously necessary, therefore, that the tub be capable of handling high bending, compression, tension and shear forces. With reference to FIGS. 3 and 4, the tub 6 comprises a circular outer peripheral wall 70, an inner ring wall 72, a top circular wall welded to an upper edge 104 of the outer peripheral wall 70, and a bottom circular wall 76 welded to a lower edge 106 of the outer peripheral wall 70 and resting on the ground. Upstanding from the upper circular wall 74 are a plurality of angularly spaced apart webs 78 on which is mounted a circular support ring 80, both of which comprise a part of the rail support 14 for the lower rail 18 and the swing drive and support mechanism 16. A circular plate 82 extends upward from the bottom circular wall 76 through the top circular wall 74 and against the support ring 80 and is welded to the upper and lower walls 74, 76 and the ring 80 for further support of the lower rail 18.

As shown in FIG. 3, a plurality of radial support plates 84 are welded to the inner ring wall 72 and extend radially outward from the ring 72. The radial plates 84 are vertically disposed relative to the views of FIGS. 3 and 4 in which the tub 6 rests on the ground 8. Each of the plates 84 have lengths 85 welded to the top and bottom circular walls 74 and 76. Each of the radial plates 84 also has an end 86 extending to the outer peripheral wall 70 and welded to the wall 70. A plurality of parallel chordal plates 88 are also vertically disposed and extend in directions parallel to chords of the circular outer peripheral wall 70 between locations 90 on the circular plate 82. The chordal plates 88 are welded along their lengths 89 to the top and bottom circular walls 74, 76 and at their opposite ends 91, 93 to the circular plate 82 at two of the locations 90. A second plurality of parallel chordal plates 92 are vertically disposed and extend between locations 90 on the circular ring 82 in directions parallel to a chord of the circular outer peripheral wall 70. The chordal plates 92 are positioned at an angle a of 60°, as shown in FIG. 3, relative to the chordal plates 88 such that each of the chordal plates 92 intersect; at an intersection 96 one of the plurality of the chordal plates 88. The chordal plates 92 are welded along their lengths 94 to the top and bottom walls 74, 76 and at their opposite ends 95, 97 to the circular plate 82 at two of the locations 90. A third plurality of parallel chordal plates 98 are vertically disposed and extend between locations 90 on the circular ring 82 in directions parallel to a chord of the circular outer peripheral wall 70. The chordal plates 98 are welded along their lengths 99 to the top and bottom walls 74, 76 and at their opposite ends 101, 103 to the circular plate 82 at two of the locations 90. The chordal plates 98 are positioned at an angle b of 60° relative to the chordal plates 88 and at an angle c of 60° relative to the chordal plates 92 as shown in FIG. 3, such that each of the chordal plates 98 intersects at an intersection 96 one of the plurality of the chordal plates 88 and one of the chordal plates 92. The total plurality of chordal plates thus comprise a plurality or group of chordal plates 88, a plurality or group of chordal plates 92, and a plurality or group of chordal plates 98, which are disposed at 60° angles to each other and form a plurality of intersections with angularly adjacent plates at 60° angles. Also, the total plurality of chordal plates forms a plurality of groups of three chordal plates in which each of the groups defines one of the intersections 96. Each group comprises a chordal plate 88, a chordal plate 92, and a chordal plate 98. Each one of the radial plates 84 is disposed parallel to the chordal plates of one of the plurality or groups of chordal plates 88, 92, 98 and at 60° angles to the chordal plates of the other of the two plurality or groups. The plurality of radial plates and the total plurality of chordal plates together comprise a plurality of groups of two chordal plates and one radial plate in which each of the groups form a plurality of intersections 102.

A plurality of equilateral sided triangular compartments 110 of equal size are formed by chordal plates 88, 92 and 98. Each of the triangular compartments 110 has sides 112, 114 and 116 respectively comprising a part of the lengths of chordal plates 88, 92 and 98. A second plurality of equilateral sided triangular compartments 120 of equal size and also equal in size to compartments 110 is formed by one of the radial plates 84 and two chordal plates of the three chordal plates 88, 92 and 98. Each of the triangular compartments 120 has a side 122 comprising a portion of one of the radial plates 84, a second side comprising one of the sides 112, 114, 116 corresponding to a portion of one of the chordal plates 88, 92 or 98, and a third side comprising a different one of the sides 112, 114 and 116. Each of the intersections 96 define apexes at each of the triangular compartments 110 and 120. With the exception of the compartments 110 most adjacent the circular plate 82, each of the triangular compartments 110 and 120 has an access opening 124 through the upper circular wall 74. The tub 6 also includes a plurality of non-triangular shaped compartments 128, 130, 132 and 134 adjacent the outer periphery of the tub. However, the triangular compartments 110 and 120 are greater in number than the non-triangular compartments 128, 130, 132 and 134 and preferably comprise at least 100% of total number of triangular and non-triangular compartments. Also, a plurality of relatively small, somewhat rectangular shaped compartments 136 are located along the circular outer peripheral wall 70.

Figure 5:
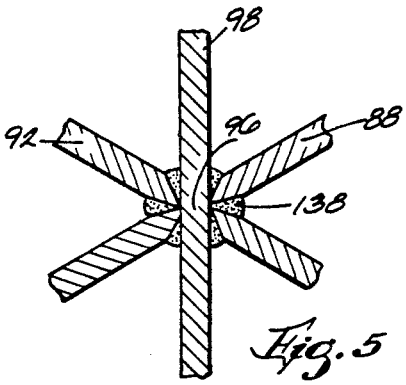
FIG. 5 is an enlarged and broken away portion of FIG. 3.

With reference to FIG. 5, an enlarged broken away portion of FIG. 3 illustrates an intersection such as intersection 102 of a radial plate 84 and chordal plates 92 and 98. As shown in both FIG. 3 and in FIG. 5, the angle of intersection of each chordal plate and radial plate relative to the most adjacent plates is at an angle of 60°. The plates are welded together at the intersection to form a high strength joint at the apexes of six of the triangular compartments. The size of the weld fillet 138 between each angularly adjacent plate is small in an angular direction relative to plate intersections forming an angle such as 90° between the plates, e.g., the weld material volume of a 60° weld is ½ of that for a 90° weld having an equal plate thickness and joint strength. The smaller volume of weld material for a 60° angular width weld not only requires less material, but it also permits decreased weld time due to the depositing of less weld material. Also, less heat is absorbed by the plate structure so that there is less distortion of the plates during the welding of the tub. The 60° angular weld width also permits the necessary accessibility to the intersection area to permit the weld to be made.

The tub 6 includes the lifting stool 140 through which the lifting pin 10 passes for lifting the tub with the frame 2 and deck 4 when the excavating machine is moved by the walk mechanism 28. With reference to FIG. 4, the lifting stool 140 includes the inner ring wall 72 having an upper ring section 142 and a lower ring section 144, a pintle support plate 146, a tub lifting plate 148, and a lifting nut chamber 149. The lower ring section 144 has an upper circular edge 150 welded along the bottom peripheral surface 152 of the lifting plate 148 and a lower circular edge 154 welded to the bottom circular wall 76 of the tub. The upper ring section 142 has an upper circular edge 156 welded to the pintle support plate 146 and a lower circular edge welded to a top peripheral surface 160 of the tub lifting plate 148. The tub lifting plate 148 is thus "sandwiched" between the upper and lower ring sections 142, 144 and its circumferential surface 162 forms a part of the ring wall 72. An access opening 164 is provided in the ring wall 72 below a cut-out section 166 of a radial plate 84 (see FIG. 1) for permitting movement of the lifting nut 170 into and out of the nut chamber 149. The center pintle 168 is bolted onto the pintle support plate 146 and the lift pin 10 extends downward from the deck 4 through the pintle 168, into the lifting stool 140, and through the opening 172 in the lifting plate 148 into the nut chamber. The lower end 174 of the pin 10 is threaded and the lifting nut is threadably attached to the pin 10 and held securely in place by nut locking plate 176 bolted to the bottom of the nut.

During movement of the excavating machine by the walk mechanism 28, the entire tub 6 is lifted upward with the frame and the deck by the lifting pin 10. The lifting nut 170 attached to the pin 10 bears against the tub lifting plate 148 so that the entire lifting force of the pin 10 is applied, through the plate 148 and the ring wall 72 of the stool, to the tub 6. The stresses on the lifting stool 140 during lifting of the tub 6 are very substantial due to the very large weight of the tub. For example, such tubs for larger excavating machines will weigh approximately 45–50 tons. Although the lifting stool 140 is relatively simple in construction, utilizing relatively few members and requiring relatively few weldments, its use of the circular wall construction and the sandwiched lifting plate 148 between the upper and lower sections of the ring wall provide a very high strength structure which readily withstands the forces created by the stress placed on the tub when it is lifted during walking movement of the excavating machine. Such construction provides not only the necessary strength but durability for the tub and simplicity and economy in manufacture of the lifting stool aspect of the tub.

Both during normal operation of the dragline excavating machine when the tub 6 is resting on the ground and the entire weight of the machine is supported on the tub and during walking movement of the machine when the tub is lifted and set down on the ground, the entire structure of the tub is subject to very substantial stresses due to the high weight and forces resulting from movement of the excavating machine. Such forces are exacerbated by uneven ground upon which the tub may be resting, and the swinging and dragging, lifting and dumping movements of the machine. The radial plates 84 in the tub extend through the ring wall 72 across the full diameter of the tub to provide beam support across the tub which is particularly important when the tub is sitting on uneven ground. With the radial plates, beam support is provided by the tub at any location on the tub along which bending forces are applied. Due to the intersection of three chordal or two chordal and one radial support plates through a large portion of the tub, a load applied at any point to the tub will radiate or be distributed in six different directions along the length of the plates to provide a very desirable distribution of load on the tub. This is in contrast to box compartment type tubs in which the load can radiate in only four directions due to the intersecting of only two plates at approximately 90° angles to each other. The equilateral triangle compartments 110 and 120 resulting from the intersection of chordal plates or radial and chordal plates provides increased tub strength due to the greater rigidity of triangular sided compartments than the compartments of other tubs such as tubs having rectangular box type compartments. Thus, the triangular compartments increase the ability of the tub to withstand the stresses of the digging machine and decrease the need for additional load bearing reinforcements. Also, since the triangular compartments are of the same size and shape, and equilateral, greater manufacturing efficiency is obtained since fabrication of members and work procedures to assemble the members are the same for a large part of the tub manufacture.

It will be understood that the foregoing description of the present invention is for purposes of illustration and that the invention is susceptible to a number of modifications or changes none of which entail any departure from the spirit and scope of the present invention as defined in the hereto appended claims.

What is claimed is:

1. A tub for supporting a dragline excavating machine having an outer peripheral wall, a top wall affixed to an upper edge of the outer wall, a bottom wall resting on the ground and affixed to a lower edge of the outer wall, and a circular ring positioned above the top wall, the excavating machine being rotatably supported on the ring, comprising:

an inner ring wall concentric with the circular ring;

a plurality of vertically disposed radial plates each having a length extending radially outward from the ring wall;

a plurality of vertically disposed chordal plates each having a length extending in the direction of a chord of the outer peripheral wall; and a plurality of triangular compartments each formed by the intersection of two of the chordal plates and a radial plate or a third chordal plate for supporting the excavating machine.

2. The tub according to claim 1 wherein all triangular compartments of which the tub is comprised are of the same size.

3. The tub according to claim 1 wherein:

the plurality of chordal plates includes a plurality of groups of three chordal plates forming a plurality of intersections of chordal plates; and the plurality of radial plates and the plurality of chordal plates include a plurality of groups of two chordal plates and one radial plate forming a plurality of intersections of two chordal plates and one radial plate whereby the force of the weight of the excavating machine on the tub is distributed along the plates at each one of the plurality of intersections.

4. The tub according to claim 3 wherein, in each of the groups of three chordal plates and in each of the groups of two chordal plates and one radial plate, angularly adjacent plates at each intersection are at a 60° angle to each other.

5. The tub according to claim 1 wherein:

the plurality of chordal plates include three groups of chordal plates disposed at 60° angles relative to each other; and the plurality of radial plates are each disposed parallel to the chordal plates of one of the groups of chordal plates and at a 60° angle to the chordal plates of two of the groups of chordal plates.

6. The tub according to claim 1 wherein each of the triangular compartments comprises an equilateral sided triangular compartment.

7. The tub according to claim 1 further comprising:

a plurality of non-triangular compartments each having at least two sides each formed from one of the plurality of chordal plates and plurality of radial plates; and wherein the number of triangular compartments comprises at least 60% of the total number of triangular and non-triangular compartments.

8. The tub according to claim 7 wherein the plurality of triangular compartments are of the same size.

9. The tub according to claim 1 wherein each of the radial and chordal plates has a bottom edge and a top edge respectively welded to the bottom wall and the top wall.

10. The tub according to claim 1 wherein:

each of the plurality of triangular compartments has equilateral sides, each side comprising one of the chordal and radial plates and forming a juncture with another side at each of said intersections; and a weld at each juncture having an angular width of 60° whereby the sides forming the juncture are joined together and the total weld width of all junctures is minimized due to the relatively small 60° angle weld width at each juncture.

11. A tub for supporting the weight of a dragline excavating machine having an outer peripheral wall, a top wall affixed to an upper edge of the outer wall, a bottom wall resting on the ground and affixed to a lower edge of the outer wall, and a circular ring positioned above the top wall, the excavating machine being rotatably supported on the ring, comprising:

a plurality of chordal support plates each having a length extending in the direction of a chord of the outer peripheral wall, the plurality of chordal support plates including a plurality of groups of three chordal support plates forming a plurality of intersections of chordal support plates; and a plurality of radially disposed support plates, the plurality of radial support plates and the plurality of chordal support plates including a plurality of groups of two chordal support plates and one radial support plate forming a plurality of intersections of two chordal support plates and one radial support plate whereby the force of the weight of the excavating machine on the tub is distributed in six directions along support plates at each one of the chordal or chordal and radial support plate intersections.

12. The tub according to claim 11 wherein:

the plurality of chordal plates comprises first, second and third plurality of chordal plates at 60° angles to each other; and the plurality of radial plates are each parallel to the chordal plates of one of the first, second and third plurality of chordal plates and at 60° angles to the other two of the first, second and third chordal plates.

13. The tub according to claim 11 further comprising:

an inner ring wall concentric with the circular ring; and wherein the plurality of radial support plates comprises a plurality of pairs of radial support plates, each support plate of each of said pair being in radial alignment, each support plate of each of said pairs having opposite ends respectively welded to the inner ring wall and the outer peripheral wall, each pair of radial support plates and the inner ring wall defining an integral continuous member across the entire diameter of the tub.

14. A tub for supporting a dragline excavating machine having an outer peripheral wall, a top wall affixed to an upper edge of the outer wall, and a bottom wall resting on the ground and affixed to a lower edge of the outer wall, and a circular ring positioned above the top wall, the excavating machine being rotatably supported on the ring, comprising:

a plurality of vertically disposed chordal plates each having a length extending in the direction of a chord of the outer peripheral wall;

an inner ring wall concentric with the circular ring; and a plurality of vertically disposed radial plates each intersecting at least two chordal plates and all of which have a length extending radially outward from the ring wall to the outer peripheral wall.

15. The tub according to claim 10 wherein:

the outer peripheral wall is circular in shape;

the plurality of radial plates includes a plurality of pairs of radial plates in radial alignment with each other and comprising, with the inner ring wall, a continuous diameter member of the outer peripheral wall.

* * * * *